US008746342B1

(12) United States Patent
Nish et al.

(10) Patent No.: US 8,746,342 B1
(45) **Date of Patent: *Jun. 10, 2014**

(54) WELL COMPLETION PLUGS WITH DEGRADABLE COMPONENTS

(75) Inventors: Randall W. Nish, Provo, UT (US); Randy A. Jones, Park City, UT (US); Jason Jon Vogel, Sandy, UT (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/362,185

(22) Filed: Jan. 31, 2012

Related U.S. Application Data

(63) Continuation of application No. 12/353,655, filed on Jan. 14, 2009, now Pat. No. 8,127,856.

(60) Provisional application No. 61/089,302, filed on Aug. 15, 2008.

(51) Int. Cl.
*E21B 34/00* (2006.01)

(52) U.S. Cl.
USPC ..... 166/317; 166/376; 137/68.11

(58) Field of Classification Search
USPC ..... 166/317, 323, 126, 131, 133, 142, 376; 137/67, 68.11, 271; 138/89, 90
See application file for complete search history.

(56) References Cited

U.S. PATENT DOCUMENTS 1,684,266 A 9/1928 Fisher et al.
2,043,225 A 6/1936 Armentrout et al.
2,160,804 A 5/1939 Hall et al.
2,205,119 A 6/1940 Hall et al.
2,230,712 A 2/1941 Bendeler et al.
2,249,172 A * 7/1941 Quintrell ..... 166/125
2,338,326 A 1/1944 Green
2,577,068 A 12/1951 Baker
2,589,506 A 3/1952 Morrisett
2,672,199 A 3/1954 McKenna
2,725,941 A 12/1955 Hanshaw
2,784,758 A 3/1957 Baker
3,021,902 A 2/1962 Keithahn
3,136,365 A 6/1964 Carter et al.
3,148,731 A * 9/1964 Holden ..... 166/141
3,163,225 A 12/1964 Perkins
3,211,232 A 10/1965 Grimmer (Continued)

OTHER PUBLICATIONS

U.S. Appl. No. 12/549,652, filed Aug. 28, 2009, Jason Jon Vogel; office action issued Apr. 18, 2012.

(Continued)

*Primary Examiner* — Shane Bomar
*Assistant Examiner* — Kipp Wallace
(74) *Attorney, Agent, or Firm* — Thorpe North & Western LLP

(57) ABSTRACT

A downhole tool for use in completing a well includes a plug body selectively securable to a wellbore at a desired elevation and having a flowbore. A non-dissolvable flow restrictor is operably disposed in the flowbore and operates to restrict fluid flow through the flowbore, and a time-dissolvable retainer or spacer is operably coupled to the flow restrictor to retain the flow restrictor in a first position within the flowbore. The retainer is dissolvable within a predetermined passage of time to release the flow restrictor to move between the first position and a second position within the flowbore to control the flow of fluid through the downhole tool.

21 Claims, 10 Drawing Sheets

(56) References Cited

U.S. PATENT DOCUMENTS 3,298,440 A 1/1967 Current
3,306,366 A 2/1967 Muse
3,314,480 A 4/1967 Scott
3,420,304 A 1/1969 Kilgore
3,497,003 A 2/1970 Berryman et al.
3,506,067 A 4/1970 Lebourg
3,517,742 A 6/1970 Williams
3,831,677 A 8/1974 Mullins
3,976,133 A 8/1976 Allen
4,099,563 A 7/1978 Hutchison et al.
4,151,875 A 5/1979 Sullaway
4,285,398 A * 8/1981 Zandmer et al. ..... 166/100
4,289,200 A 9/1981 Fisher, Jr.
4,312,406 A 1/1982 McLaurin et al.
4,359,090 A 11/1982 Luke
4,397,351 A 8/1983 Harris
4,432,418 A 2/1984 Mayland
4,488,595 A 12/1984 Akkerman
4,524,825 A 6/1985 Fore
4,532,989 A 8/1985 Barker
4,542,788 A 9/1985 Semar
4,553,596 A 11/1985 Graham et al.
4,664,188 A 5/1987 Zunkel et al.
4,708,202 A 11/1987 Sukup et al.
4,730,835 A 3/1988 Wilcox et al.
4,739,829 A 4/1988 Brunner
4,745,972 A 5/1988 Bell et al.
4,784,226 A 11/1988 Wyatt
4,813,481 A 3/1989 Sproul et al.
4,834,184 A 5/1989 Streich et al.
4,858,687 A 8/1989 Watson et al.
4,926,938 A 5/1990 Lindsey, Jr.
5,086,839 A 2/1992 Setterberg, Jr. et al.
5,095,978 A 3/1992 Akkerman et al.
5,131,468 A 7/1992 Lane et al.
5,188,182 A 2/1993 Echols, III et al.
5,224,540 A 7/1993 Streich et al.
5,253,709 A 10/1993 Kendrick et al.
5,271,468 A 12/1993 Streich et al.
5,333,684 A 8/1994 Walter et al.
5,340,626 A 8/1994 Head
5,390,737 A 2/1995 Jacobi et al.
5,392,856 A 2/1995 Broussard, Jr. et al.
5,404,956 A 4/1995 Bohlen et al.
5,413,172 A 5/1995 Laurel
5,422,183 A 6/1995 Sinclair et al.
5,441,111 A 8/1995 Whiteford
5,479,986 A 1/1996 Gano et al.
5,540,279 A 7/1996 Branch et al.
5,542,473 A 8/1996 Pringle et al.
5,553,667 A 9/1996 Budde et al.
5,597,784 A 1/1997 Sinclair et al.
5,607,017 A 3/1997 Owens et al.
5,613,560 A 3/1997 Jelinski et al.
5,678,635 A 10/1997 Dunlap et al.
5,701,959 A 12/1997 Hushbeck et al.
5,749,419 A 5/1998 Coronado et al.
5,765,641 A 6/1998 Shy et al.
5,787,979 A 8/1998 Giroux et al.
5,813,457 A 9/1998 Giroux et al.
5,819,846 A 10/1998 Bolt, Jr.
5,837,656 A 11/1998 Sinclair et al.
5,839,515 A 11/1998 Yuan et al.
5,904,207 A 5/1999 Rubbo et al.
5,924,696 A 7/1999 Frazier
5,941,309 A 8/1999 Appleton
5,984,007 A 11/1999 Yuan et al.
5,990,051 A 11/1999 Ischy et al.
6,009,944 A 1/2000 Gudmestad
6,026,903 A 2/2000 Shy et al.
6,056,053 A 5/2000 Giroux et al.
6,076,600 A 6/2000 Vick, Jr. et al.
6,082,451 A 7/2000 Giroux et al.
6,131,663 A 10/2000 Henley et al.
6,145,593 A 11/2000 Hennig
6,167,957 B1 1/2001 Frazier
6,167,963 B1 1/2001 McMahan et al.
6,189,618 B1 2/2001 Beeman et al.
6,220,349 B1 4/2001 Vargus et al.
6,220,350 B1 4/2001 Brothers et al.
6,244,642 B1 6/2001 Serafin et al.
6,279,656 B1 8/2001 Sinclair et al.
6,318,461 B1 11/2001 Carisella
6,318,729 B1 11/2001 Pitts, Jr. et al.
6,354,372 B1 3/2002 Carisella et al.
6,394,180 B1 5/2002 Berscheidt et al.
6,412,388 B1 7/2002 Frazier
6,431,274 B1 8/2002 Nowlin et al.
6,481,496 B1 11/2002 Jackson et al.
6,491,108 B1 12/2002 Slup et al.
6,491,116 B2 12/2002 Berscheidt et al.
6,540,033 B1 4/2003 Sullivan et al.
6,578,633 B2 6/2003 Slup et al.
6,581,681 B1 6/2003 Zimmerman et al.
6,598,672 B2 7/2003 Bell et al.
6,598,679 B2 7/2003 Robertson
6,599,863 B1 7/2003 Palmer et al.
6,651,738 B1 * 11/2003 Solfronk et al. ..... 166/133
6,651,743 B2 11/2003 Szarka
6,655,459 B2 12/2003 Mackay
6,666,275 B2 12/2003 Neal et al.
6,695,050 B2 2/2004 Winslow et al.
6,695,051 B2 2/2004 Smith et al.
6,708,768 B2 3/2004 Slup et al.
6,708,770 B2 3/2004 Slup et al.
6,712,153 B2 3/2004 Turley et al.
6,732,822 B2 5/2004 Slack et al.
6,752,209 B2 6/2004 Mondelli et al.
6,769,491 B2 8/2004 Zimmerman et al.
6,793,022 B2 9/2004 Vick et al.
6,796,376 B2 9/2004 Frazier
6,799,638 B2 10/2004 Butterfield, Jr.
6,827,150 B2 12/2004 Luke
6,976,534 B2 12/2005 Sutton et al.
6,986,390 B2 1/2006 Doane et al.
7,017,672 B2 3/2006 Owen, Sr.
7,036,602 B2 5/2006 Turley et al.
7,044,230 B2 5/2006 Starr et al.
7,049,272 B2 5/2006 Sinclair et al.
7,093,664 B2 8/2006 Todd et al.
7,124,831 B2 10/2006 Turley et al.
7,163,066 B2 1/2007 Lehr
7,168,494 B2 1/2007 Starr et al.
7,210,533 B2 5/2007 Starr et al.
7,255,178 B2 8/2007 Slup et al.
7,258,165 B1 8/2007 Williams
7,273,099 B2 9/2007 East, Jr. et al.
7,287,596 B2 10/2007 Frazier et al.
7,322,413 B2 1/2008 Rogers et al.
7,337,852 B2 3/2008 Manke et al.
7,350,582 B2 4/2008 McKeachnie et al.
7,353,879 B2 4/2008 Todd et al.
7,373,973 B2 5/2008 Smith et al.
7,380,600 B2 6/2008 Willberg et al.
7,395,856 B2 7/2008 Murray
7,452,161 B2 11/2008 Freyer et al.
7,461,699 B2 12/2008 Richard et al.
7,464,764 B2 12/2008 Xu
7,475,736 B2 1/2009 Lehr et al.
7,510,018 B2 3/2009 Williamson et al.
7,735,549 B1 6/2010 Nish et al.
7,743,836 B2 6/2010 Cook et al.
7,789,135 B2 9/2010 Turley et al.
7,880,300 B2 2/2011 Bauer et al.
7,900,696 B1 3/2011 Nish et al.
8,403,036 B2 3/2013 Neer et al.
2002/0070503 A1 6/2002 Zimmerman et al.
2002/0162662 A1 11/2002 Passamaneck et al.
2003/0155112 A1 8/2003 Tiernan et al.
2003/0188862 A1 10/2003 Streich et al.
2003/0226660 A1 12/2003 Winslow et al.
2004/0003928 A1 1/2004 Frazier
2004/0036225 A1 2/2004 Ritter et al.
2004/0045723 A1 3/2004 Slup et al.

(56) References Cited

U.S. PATENT DOCUMENTS

| | | | | |
|---|---|---|---|---|
| 2004/0177952 | A1 | 9/2004 | Turley et al. | |
| 2005/0161224 | A1 | 7/2005 | Starr et al. | |
| 2005/0189103 | A1 | 9/2005 | Roberts et al. | |
| 2005/0205264 | A1 | 9/2005 | Starr et al. | |
| 2006/0124307 | A1 | 6/2006 | Turley et al. | |
| 2006/0131031 | A1 | 6/2006 | McKeachnie et al. | |
| 2006/0278405 | A1* | 12/2006 | Turley et al. | 166/385 |
| 2007/0039160 | A1 | 2/2007 | Turley et al. | |
| 2007/0074873 | A1* | 4/2007 | McKeachnie et al. | 166/376 |
| 2007/0102165 | A1 | 5/2007 | Slup et al. | |
| 2007/0119600 | A1 | 5/2007 | Slup et al. | |
| 2007/0284097 | A1 | 12/2007 | Swor et al. | |
| 2007/0284114 | A1 | 12/2007 | Swor et al. | |
| 2008/0047717 | A1 | 2/2008 | Frazier et al. | |
| 2008/0060821 | A1 | 3/2008 | Smith et al. | |
| 2008/0073074 | A1 | 3/2008 | Frazier | |
| 2008/0073081 | A1 | 3/2008 | Frazier et al. | |
| 2008/0073086 | A1 | 3/2008 | Cook et al. | |
| 2008/0202764 | A1 | 8/2008 | Clayton et al. | |
| 2008/0257549 | A1 | 10/2008 | Swor et al. | |
| 2009/0038790 | A1 | 2/2009 | Barlow | |
| 2009/0044957 | A1 | 2/2009 | Clayton et al. | |
| 2009/0065194 | A1 | 3/2009 | Frazier | |
| 2009/0065216 | A1* | 3/2009 | Frazier | 166/373 |
| 2009/0078647 | A1 | 3/2009 | Frazier et al. | |
| 2009/0139720 | A1 | 6/2009 | Frazier | |
| 2009/0159274 | A1 | 6/2009 | Frazier | |
| 2009/0178808 | A1 | 7/2009 | Williamson et al. | |
| 2010/0024703 | A1* | 2/2010 | Zampiello et al. | 114/198 |
| 2010/0155050 | A1 | 6/2010 | Frazier | |
| 2010/0276159 | A1 | 11/2010 | Mailand et al. | |
| 2010/0282004 | A1 | 11/2010 | Nance et al. | |
| 2010/0288487 | A1 | 11/2010 | Turley et al. | |
| 2011/0079383 | A1 | 4/2011 | Porter et al. | |

OTHER PUBLICATIONS

Baker Hughes; Baker Oil Tools Remedial Systems Technical Unit Quik Drill Composite Bridte Plug and Wireline Adapter Kit Product Family Nos. H40129 and H43848; Feb. 28, 2002; pp. 1-12.

Weatherford FracGaurd Composite Plugs; 2004; 7 pages.

BJ Python Composite Bridge Plug; Product Information; Sep. 20, 2001; 1 page.

Halliburton FAS Drill Squeeze Packers; Drillable Tools; 1999; 6 pages.

Weatherford Completion Systems FracGuard Series Composite Frac Plug 2001; Brochure No. 432.00 and 433.00; 2 pages.

BioBalls MR, Soluble Ball Sealers; www.santrol.com; Applicant believes that the Bioballs ere offered for sale prior to the filing date of applicant's application.

U.S. Appl. No. 12/253,337, filed Oct. 17, 2008, Randall Nish.

U.S. Appl. No. 12/353,655, filed Jan. 14, 2009, Randall Nish.

U.S. Appl. No. 12/549,652, filed Aug. 28, 2009, Vogel.

Composite Plugs; Magnum Oil Tools International; 19 pages.

U.S. Appl. No. 13/176,107, filed Jul. 5, 2011, Randall Nish.

U.S. Appl. No. 12/916,095, filed Oct. 29, 2010, Randall Nish.

U.S. Appl. No. 12/549,652, filed Aug. 28, 2009, Jason Jon Vogel; notice of allowance issued May 23, 2012.

U.S. Appl. No. 12/916,095, filed Oct. 29, 2010, Randall William Nish; office action dated Mar. 20, 2013.

U.S. Appl. No. 12/253,337, filed Oct. 17, 2008, Randall W. Nish; office action dated May 2, 2013.

U.S. Appl. No. 13/176,107, filed Jul. 5, 2011, Nish; office action dated Sep. 11, 2013.

* cited by examiner

WELL COMPLETION PLUGS WITH DEGRADABLE COMPONENTS

PRIORITY CLAIM AND RELATED APPLICATIONS

This is a continuation of U.S. patent application Ser. No. 12/353,655, filed Jan. 14, 2009 now U.S. Pat. No. 8,127,856; which claims priority to U.S. Provisional Application Ser. No. 61/089,302, filed Aug. 15, 2008; which are incorporated herein by reference in their entirety.

FIELD OF THE INVENTION

The present invention relates generally to well completion devices and methods for wells, such as natural gas and oil wells. More particularly, this invention relates to a hybrid well completion plug, method and kit, that initially acts as a bridge plug but subsequently acts as a fracture ("frac") plug. Further, this invention also relates to a hybrid well completion plug, method and kit, that initially acts as an "open" plug without restrictions in either direction but subsequently acts as a fracture ("frac") plug.

BACKGROUND OF THE INVENTION AND RELATED ART

Just prior to beginning production, oil and natural gas wells are completed using a complex process called "fracturing." This process involves securing the steel casing pipe in place in the wellbore with cement. The steel and cement barrier is then perforated with shaped explosive charges and the surrounding oil or gas reservoir is stimulated or "fractured" in order to start the flow of gas and oil into the well casing and up to the well head. This fracturing process can be repeated several times in a given well depending on various environmental factors of the well, such as the depth of the well, size and active levels in the reservoir, reservoir pressure, and the like. Because of these factors, some wells may be fractured at only a few elevations or depth locations along the wellbore and others may be fractured at as many as thirty (30) or more elevations.

As the well is prepared for fracturing at each desired elevational level or zone of the well, a temporary well completion plug is set in the bore of the steel well casing pipe with a setting tool just below the level where the fracturing will perforate the steel and cement barrier. When the barrier is perforated, "frac fluids" and sand are pumped down to the perforations, and into the reservoir. At least a portion of the fluids and sand are then drawn back out of the reservoir in order to stimulate movement of the gas or oil at the perforation level. Use of the temporary plug prevents contaminating the already fractured levels below.

This process is repeated several times, as the "frac" operation moves up the wellbore or "downhole" until all the desired levels have been stimulated. At each level, the temporary completion plugs are usually left in place, so that they can all be drilled out at the end of the process, in a single, but often time-consuming drilling operation. One reason the drilling operation has been time intensive is that the temporary plugs have been made of cast iron which has generally required several passes of the drilling fixture to completely drill out the plug. To reduce the drill out time, another type of downhole plug has been developed that is made of a composite material. Composite plugs are usually made of, or partially made of, a fiber and resin mixture, such as fiberglass and high performance plastics. Due to the nature of the composite material, composite plugs can be easily and quickly drilled out of a wellbore in a single pass drilling operation.

Temporary well completion plugs used in the fracturing operation described above, whether made of cast iron or composite materials, often come in two varieties, bridge plugs and frac plugs. Bridge plugs restrict fluid movement in either the upward or downward direction. Bridge plugs are used to temporarily or permanently seal off a level of the wellbore. Frac plugs generally behave as one-way valves that restrict fluid movement down the wellbore, but allow fluid movement up the wellbore.

In use, when frac fluids and sand are pumped down to a newly perforated level of the wellbore, a frac plug set in the wellbore just below the perforation level can restrict the frac fluids and sand from traveling farther down the wellbore and contaminating lower fractured levels. However, when the frac fluid and sand mixture is pumped back up the well to stimulate the reservoir at the newly fractured level, the one-way valve of the frac plug can open and allow gas and oil from lower levels to be pumped to the well head. This is advantageous to the well owner because it provides immediate revenue even while the well is still being completed.

Other situations exist, particularly during the completion of horizontal gas and oil wells, where the orientation of the wellbore precludes using gravity to lower the well plug into position. Instead, the plug is pumped into position by pumping fluid into the well from the surface, which process also requires that a portion of the well fluids flow to move the plug into position. If the plug or setting tool malfunctions, the operation of either a bridge plug or frac plug can prevent the placement of a second well plug by stopping the downward flow of fluid. Consequently, in horizontal wells each malfunctioning bridge or frac plug must be drilled out and replaced, again resulting in a time consuming and expensive operation.

Additionally, it will be appreciated that well completion plugs are typically fabricated as either a bridge plug or a frac plug, and one can not be converted into the other at the well site. Because of this limitation, well completion workers are forced to guess how many of each type of plug they will need to take with them to a remote well site so that they have plenty of both types of plugs for whatever the well conditions require. Unfortunately, this leads to expensive inefficiencies because either too many of one or both kinds of costly plugs are taken, or not enough of one or the other is taken to the remote well location.

SUMMARY OF THE INVENTION

The inventors of the present invention have recognized that it would be advantageous to develop a well completion plug that has a degradable or dissolvable component that secures a flow restrictor, such as a bridge plug or a frac plug or ball, in a first position, and allows the flow restrictor to move between the first position and a second position after the degradable component has degraded or dissolved. More particularly, the inventors of the present invention have recognized that in some cases it would be advantageous to develop a well completion plug that behaves like a bridge plug for a temporary period of time, and then changes to behave like a traditional frac plug to allow flow of gas or oil from the reservoir up to the well head, before drilling the plug out and without any other intervention down the wellbore. The inventors have also recognized that in other cases it would be advantageous to develop a completion plug that behaves like an open wellbore for a temporary period of time, and then changes to behave like a traditional frac plug after the degradable component has degraded or dissolved.

The inventors of the present invention have also recognized that it would be advantageous to develop a well completion plug or kit with interchangeable components that can be interchanged in the field and prior to installation of the downhole tool into the well to form a traditional bridge or frac plug, a convertible bridge or frac plug, or a convertible open-to-frac plug, based on the immediate environmental conditions or operational requirements of the well.

In one aspect, the present invention provides a downhole tool for use in completing a well. The downhole tool includes a plug body that is selectively securable to a wellbore at a desired depth and, and which has a flowbore formed through the center thereof. The tool can also include a non-dissolvable flow restrictor disposed in the flowbore and which is operable to restrict a flow of fluids through the flowbore, and a time-dissolvable retainer or spacer operably coupled to the flow restrictor to retain the flow restrictor in a first position within the plug body. The retainer or spacer is dissolvable within a predetermined passage of time to release the flow restrictor to move between the first position and a second position within the plug body In another aspect, the present invention comprises a downhole tool system for completing a well. The tool system includes a plug body that is selectively securable to a wellbore at a desired depth and which has a flowbore formed therein, and a flow valve comprising a plurality of interchangeable components that are selectively disposable in the flowbore to control fluid flow therethrough. The plurality of interchangeable components include a non-dissolvable flow restrictor disposed in the flowbore and operable to restrict a flow of fluids through the flowbore, and a time-dissolvable retainer or spacer that is operably coupled to the flow restrictor to retain the flow restrictor in a first position within the plug body, the retainer or spacer being dissolvable within a predetermined passage of time to release the flow restrictor to move between the first position and a second position within the plug body. Moreover, the interchangeable components are selectively configurable to retain the flow valve in an open position allowing a bi-directional flow of fluids through the flowbore, or in a closed position preventing the flow of fluids in either direction through the flowbore, until after the time-dissolvable retainer has dissolved.

In another aspect, the present invention comprises a downhole tool system for completing a well. The tool system includes a plug body selectively securable to a wellbore at a desired depth and which has a flowbore formed therein, a flow valve assembled from a plurality of interchangeable components selectively disposable in the flowbore to control fluid flow therethrough. The plurality of interchangeable components include: a permanent bridge plug securable in the flowbore of the plug body by a permanent retainer to permanently restrict fluid flow through the flowbore; a permanent frac ball movable in the flowbore of the plug body between an open position that allows one-directional fluid flow through the flowbore and a closed position that restricts fluid flow through the flowbore; and a degradable retainer disposable in the flowbore with the permanent frac ball or a movable flow restrictor to temporarily retain the permanent frac ball or the movable flow restrictor in a closed position or an open position, the degradable retainer being degradable or dissolvable in a predetermined passage of time inside a natural wellbore environment to release the permanent frac ball or the flow restrictor to move.

BRIEF DESCRIPTION OF THE DRAWINGS

Features and advantages of the invention will be apparent from the detailed description that follows, and which taken in conjunction with the accompanying drawings, together illustrate exemplary features of the invention. It is understood that these drawings merely depict exemplary or representative embodiments of the present invention and are not, therefore, to be considered limiting of its scope. And furthermore, it will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings, in which.

DETAILED DESCRIPTION OF EXEMPLARY EMBODIMENTS

Figure 1:
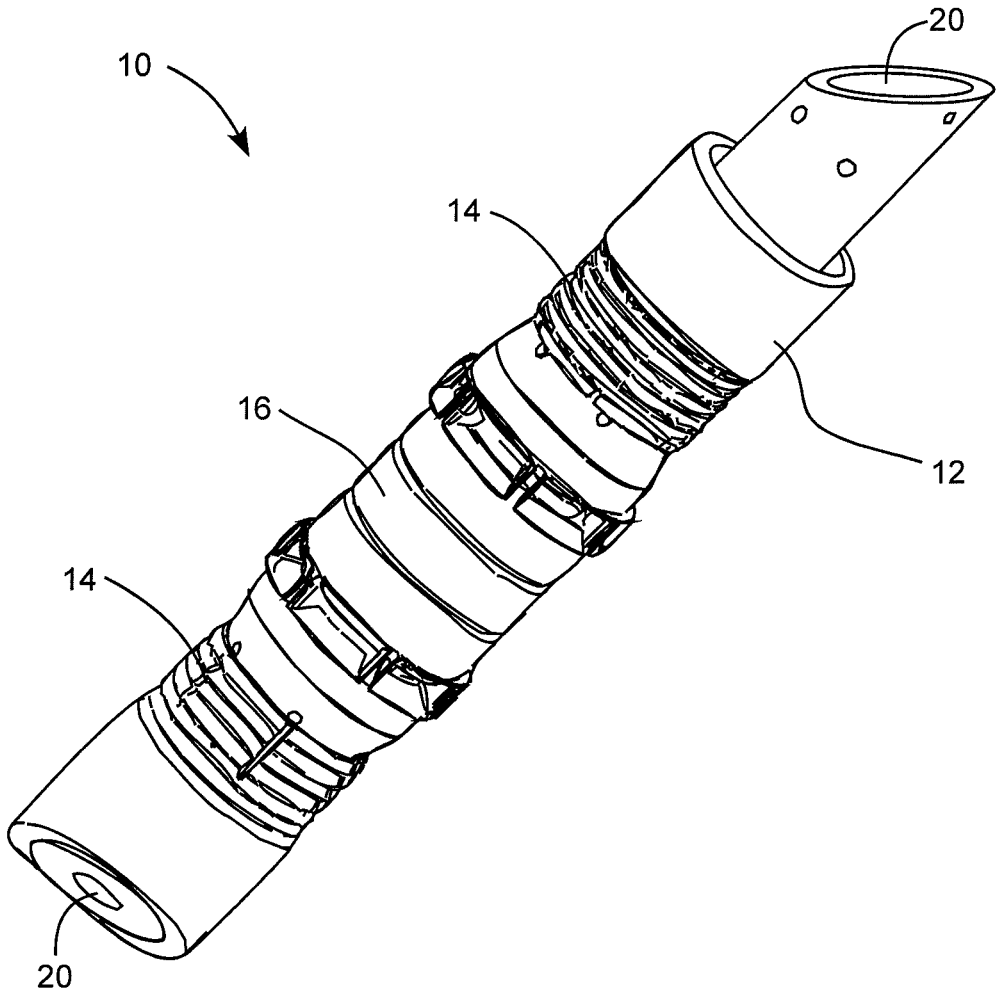
FIG. 1 is a perspective view of a downhole tool for a well.

The following detailed description of the invention makes reference to the accompanying drawings, which form a part thereof and in which are shown, by way of illustration, exemplary embodiments in which the invention may be practiced. While these exemplary embodiments are described in sufficient detail to enable those skilled in the art to practice the invention, it should be understood that other embodiments may be realized and that various changes to the invention may be made without departing from the spirit and scope of the present invention. As such, the following more detailed description of the exemplary embodiments of the present invention is not intended to limit the scope of the invention as it is claimed, but is presented for purposes of illustration only:

to describe the features and characteristics of the present invention, and to sufficiently enable one skilled in the art to practice the invention. Accordingly, the scope of the present invention is to be defined solely by the appended claims.

The present invention describes system and method for a well completion plug or downhole tool that can comprise a plug body having a flowbore. The completion plug is convertible from a first state of fluid flow through the flowbore to a second state of fluid flow through the flowbore without intervention from the surface and under normal wellbore operating conditions of temperature, pressure and pumping/frac fluids chemistry. For instance, in one aspect of the invention the flowbore in the downhole tool can be converted from a closed or sealed state to a one-way valve operation. In another aspect of the invention the flowbore can be converted from an always-open state to a one-way valve operation. The present invention also describes a method and system for a downhole well completion tool having a variety of inter-changeable valve components that can be preconfigured, prior to installation within the wellbore, to maintain or convert between a variety of different flow states, depending upon the desired process for completing the wellbore.

The present invention provides several significant advantages over prior related downhole completion tools, some of which are recited here and throughout the following more detailed description. One advantage is the significant reduction in the time and money spent in completing a well when the downhole tool or plug can be converted from one flow state to another without surface intervention such as lowering a drilling fixture into the wellbore to drill out and remove the installed completion plug.

In one aspect of the invention, for example, well production and subsequent revenue can be increased by converting the downhole tool from a completely closed completion plug that seals off the portions of the wellbore below the plug during a fracturing operation, to a completion plug with an upwardly-flowing one-way valve allowing for production from the lower portions of the wellbore between fracturing operations. Thus, gas or oil can be produced up to the wellhead even before the well is completely finished.

In another aspect of the invention, reliability in placing the downhole tool or well completion plug in a horizontal well can be increased by maintaining the flowbore of the plug body in an always-open state of fluid flow until it is confirmed that the completion plug is in the correct position. Thus, if for some reason the plug fails to set at the correct position a second plug can be advanced and installed without having to first remove the malfunctioning plug with the drilling fixture.

In yet another aspect of the invention, the ability to preconfigure the downhole tool or well completion plug at the drill site to maintain or convert between a variety of different flow states, depending upon the desired process for completing the wellbore, can also reduce the cost of completion operations. For instance, a completion plug design having variety of interchangeable valve components configurable within standard-sized plug bodies can significantly reduce the inventory requirements for downhole tool components that must be stocked at the drill site, as well as reduce or eliminate costly delays when the desired special-purpose plug is unavailable.

Each of the above-recited advantages will be apparent in light of the detailed description set forth below and best understood with reference to the accompanying drawings, wherein the elements and features of the invention are designated by numerals throughout. These advantages are not meant to be limiting in any way. Indeed, one skilled in the art will appreciate that other advantages may be realized, other than those specifically recited herein, upon practicing the present invention.

Figure 2:
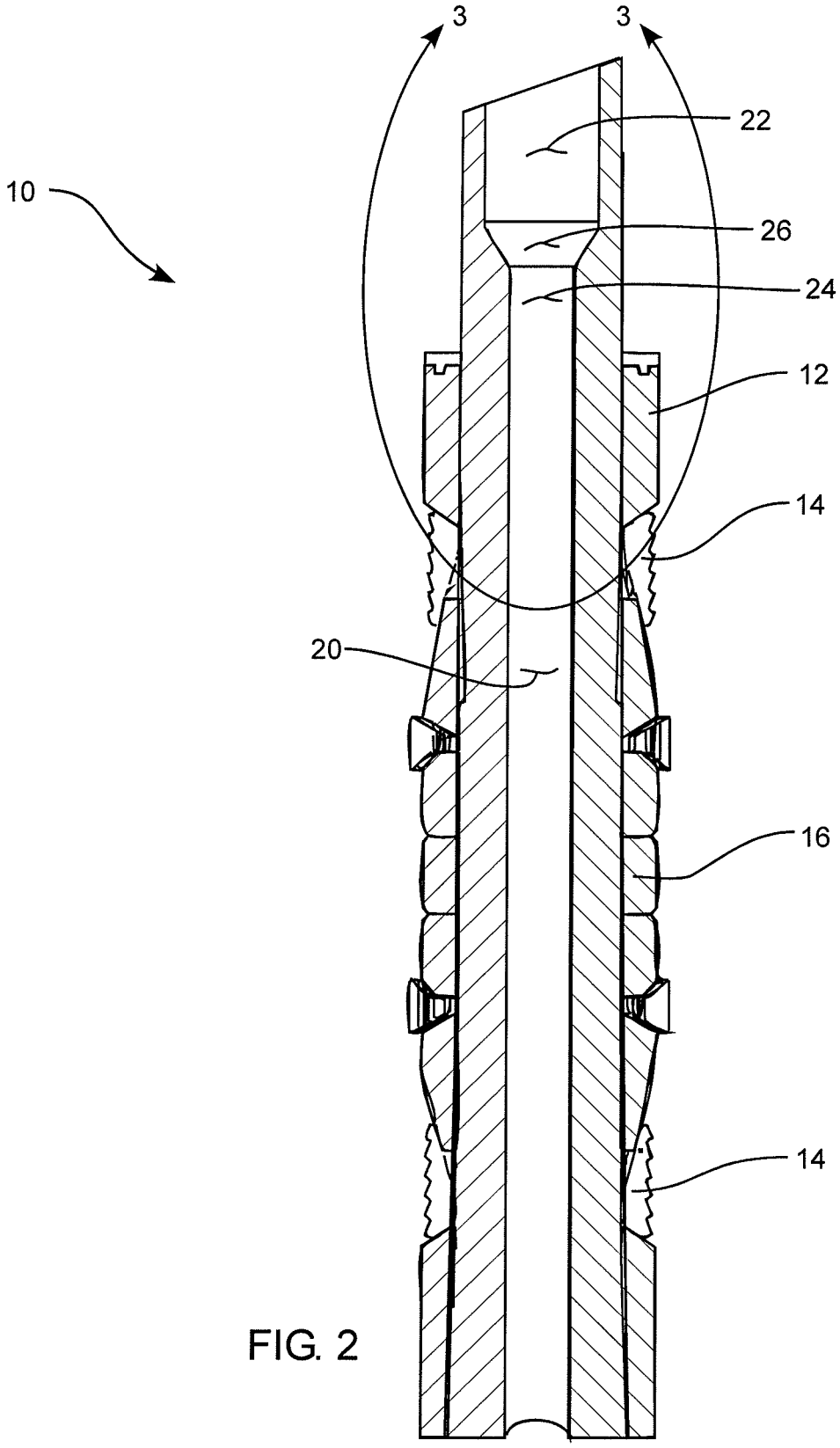
FIG. 2 is a cross-sectional view of the downhole tool of FIG. 1, in accordance with an exemplary embodiment of the present invention.

Illustrated in FIGS. 1-2 is a well completion plug or downhole tool 10 in accordance with an exemplary embodiment of the present invention. The downhole tool can comprise a plug body 12 having a pair of slip rings 14, one at each end, that can be fractured and expanded under compression from a setting tool to secure the plug body to the casing of a wellbore (not shown). Thus, the slip rings 14 allow the plug body 12 to be secured to the wellbore at a desired depth or elevation within the well. The plug body can further include an elastomeric gasket or seal 16 that can be expanded under compression to seal the wellbore around the outside of the plug body to restrict fluid from getting around the outside of the plug body 12.

As described above, the plug body can be made of cast iron. However, the present invention can also comprise a composite plug body made of, or partially made of, a fiber and resin mixture, such as fiberglass and high performance plastics. Other components may be made of cast iron, rubber and plastic. These composite plugs can be strong enough to withstand the very hostile wellbore environment, with pressures of up to 10,000 psi., and temperatures of up to 350° F., for periods of up to several weeks or longer. Yet, due to the nature of the composite material, the composite plugs can be easily and quickly drilled out of a wellbore in a single pass drilling operation.

An example of a composite plug body is found in the inventors' co-pending U.S. patent application Ser. No. 11/800,448, entitled "Drillable Down Hole Tool", and filed May 3, 2007, which application is incorporated by reference in its entirety herein for all purposes. It will be appreciated that the tool shown in FIGS. 1-2 and described in U.S. patent application Ser. No. 11/800,448 are exemplary, and that other types of tools, whether composite or cast iron, can be used with the present invention. Alternatively, the plug body can be formed of, or can include, metal, such as aluminum.

As shown in FIG. 2, the plug body 12 can further include a flowbore 20 through which fluids can flow. The flowbore 20 can be cylindrical in shape, and can include an upper cavity 22 or hollow near the upper portion of the plug body 12 having a larger diameter, and a main passage 24 passing through the middle and lower portions of the plug body 12 having a smaller diameter. The diameter of the upper cavity 22 can be relatively larger than the diameter of the main passage 24 of the flowbore to accommodate various interchangeable components of a valve, such as a flow restrictor and a retaining annulus or pin, as will be described below. A tapered transition region 26 can join the upper cavity 22 and the main passage 24, and can provide a sealing surface against which the flow restrictor of the valve can form a seal to restrict or block the flow of fluid through the flowbore.

Figure 3:
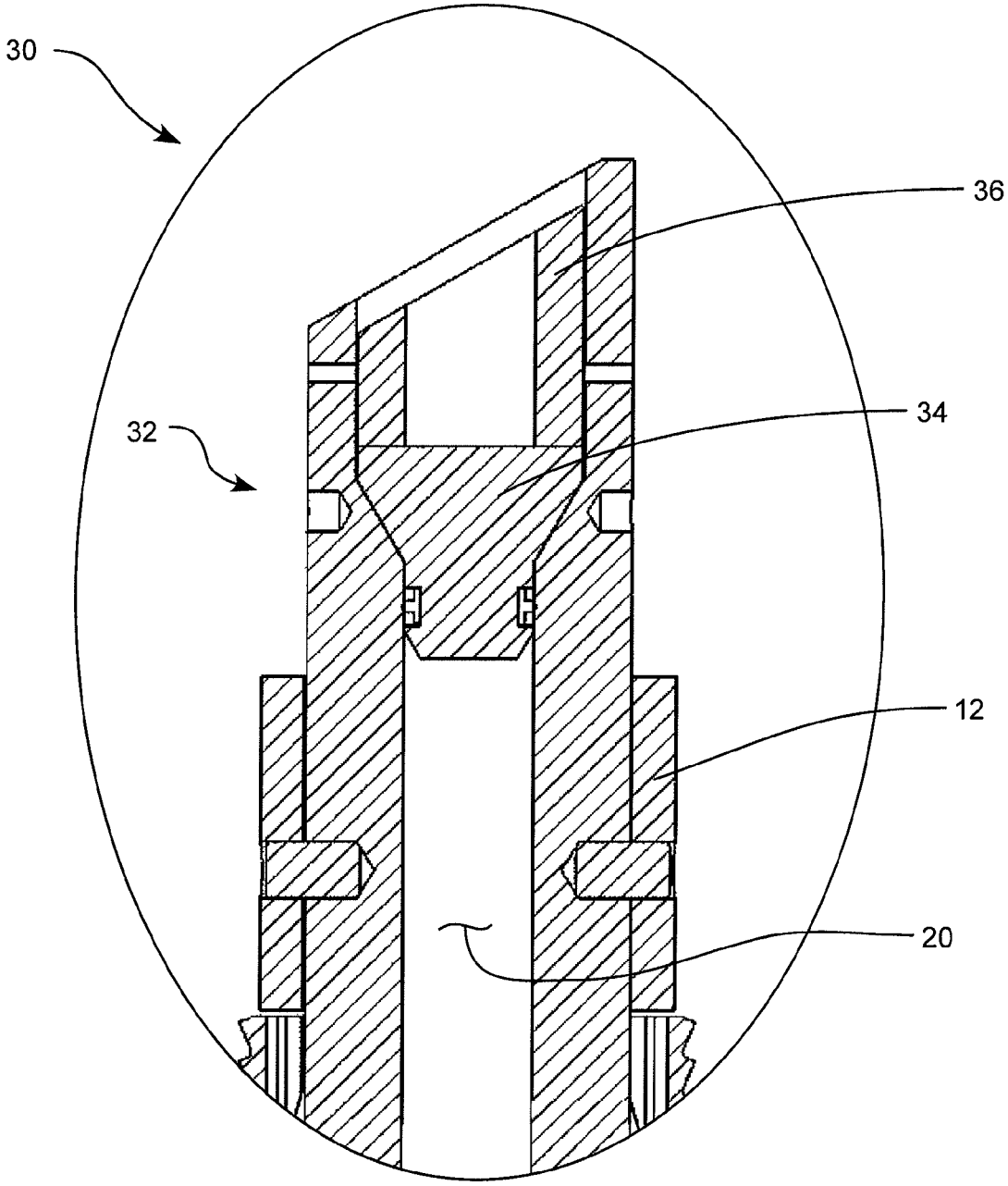
FIG. 3 is a cross-sectional view of the downhole tool of FIG. 1 configured as a bridge plug.
Figure 4:
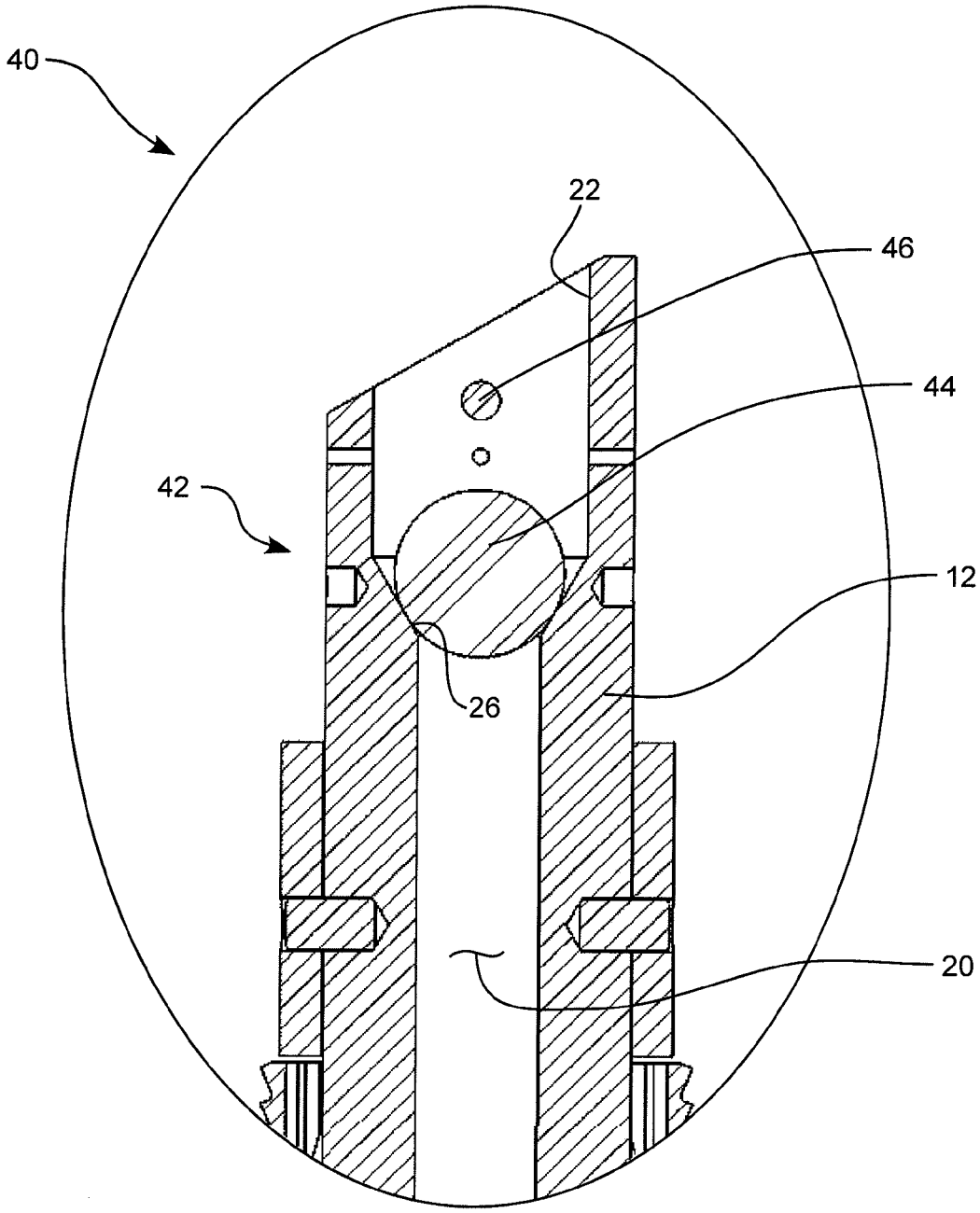
FIG. 4 is a cross-sectional view of the downhole tool of FIG. 1 configured as a fracture plug.

In one aspect, the downhole tool 10 of FIGS. 1 and 2 can be configured as a traditional bridge completion plug, indicated generally at 30 in FIG. 3, or a traditional frac completion plug, indicated generally at 40 in FIG. 4. Bridge completion plugs 30 can have a permanent bridge seal 32 with a bridge plug 34 (or flow restrictor) that closes off and seals the flowbore 20 in the plug body 12 in order to restrict fluid movement in either the upward or downward direction. The bridge seal 32 can also include a permanent annulus or retainer 36 positioned across upper cavity 22 to hold the bridge plug 34 in place when pressure below the downhole tool becomes greater than the pressure above. Bridge completion plugs 30 are used to temporarily or permanently seal off a level of the wellbore.

In contrast, frac completion plugs 40 generally behave as one-way ball valves 42 that restrict fluid movement down the wellbore, but allow fluid movement up the wellbore. For example, as shown in FIG. 4, a movable frac plug or ball 44 (or flow restrictor) is placed in the upper cavity 22 such that pressure from above the plug body 12 will force the frac ball 44 down against the tapered surface 26 or valve seat, thereby restricting fluid flow through the flowbore 20. However, pressure from below the plug body 12 will move the frac ball 44 away from the tapered surface 26 such that fluid can flow through the plug body. A retaining pin 46 can be positioned across upper cavity 22 to keep the frac ball 44 from exiting the flowbore 20 when fluids are flowing upwards through the frac valve 42.

Figure 5:
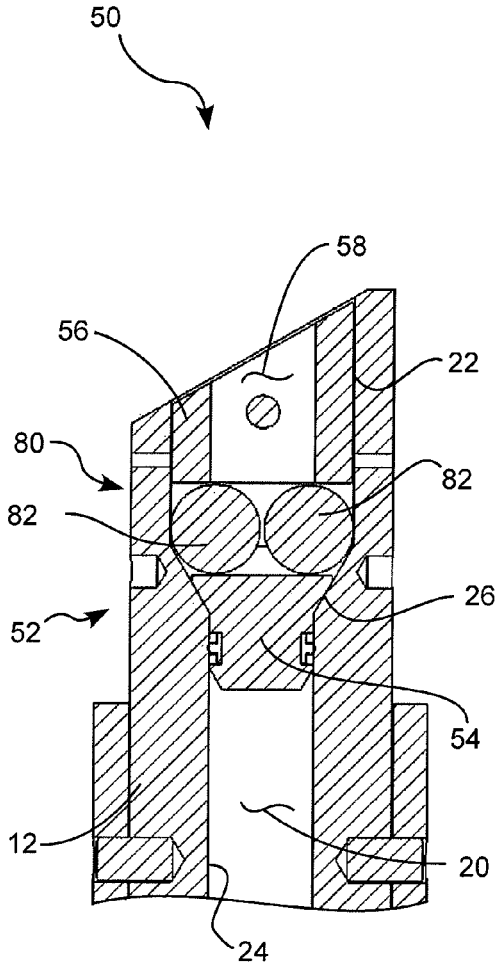
FIG. 5 is a cross-sectional view of the downhole tool of FIG. 1 in accordance with another exemplary embodiment of the present invention, shown with a valve or slug in a closed configuration.
Figure 6:
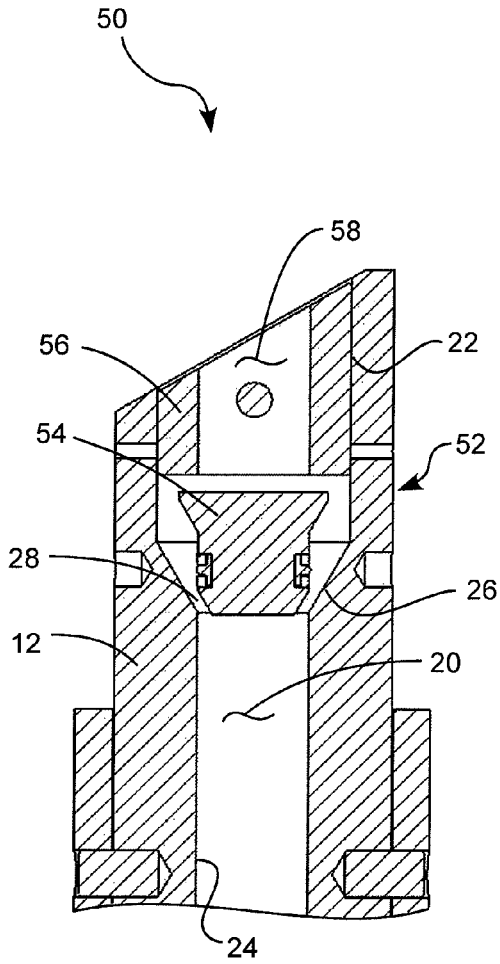
FIG. 6 is a cross-sectional view of the downhole tool of FIG. 5, shown with the valve or slug in an open configuration.

Illustrated in FIGS. 5-6 is a cross-sectional view of the downhole tool of FIGS. 1-2, in accordance with another exemplary embodiment 50 of the present invention. In this configuration, the downhole tool 50 includes a convertible bridge valve 52 that is convertible from a bridge plug that seals off the wellbore to a fracture or "frac" plug that acts as a one-way valve allowing gas or oil to flow upward from the well but restricts fluid down into the well. The downhole tool 50 can be converted from the bridge plug to the frac plug after installation in the wellbore and without any other intervention down the wellbore.

The downhole tool 50 can include a plug body 12 and a convertible bridge valve 52 that further comprises a flow restrictor or bridge plug 54, an annulus 56 with a through aperture 58, and a degradable or dissolvable retainer, indicated generally at 80. The bridge plug 54 can be operably disposed in the flowbore 20 of the plug body 12 to restrict or block the flow of fluids through the flowbore. Furthermore, the bridge plug 54 can be movably disposed within the upper cavity 22 of the flowbore 20, as shown in FIG. 5, and can be positionable in a closed position against the transition region 26 and the main passage 24 of the flowbore 20 in order to seal the plug body 12 against fluid flow.

A degradable or dissolvable retainer 80 or spacer can be associated with the convertible bridge valve 52 and can be positionable between annulus 56 and the bridge plug 54 to retain the bridge plug in the closed position, restricting the upward movement of the bridge plug and sealing the flowbore 20 to restrict fluid flow through the plug body 12. The degradable retainer 80 can degrade or dissolve over time and under certain environmental conditions in order to allow the bridge plug 54 to move into the upper cavity 22 of the flowbore 20 that was previously occupied by the intact degradable retainer 80 (see FIG. 6). The bridge plug can be prevented from moving entirely out of the upper cavity 22 by the annulus 56. When the bridge plug 54 moves into the upper cavity 22, a gap 28 opens between the tapered transition region 26 of the flowbore 20 and the bridge plug 54, allowing fluid to flow freely through the flowbore. Thus, the degradable retainer 80 can degrade in order to allow the flow restrictor or bridge plug 54 of the valve 52 to move between the first closed position and a second open position that allows fluid to flow through the downhole tool 50.

In one aspect of the present invention, the degradable retainer 80 or spacer can include a biodegradable material that can degrade or dissolve over a predetermined time when exposed to a set of predetermined environmental conditions. The environmental conditions can include that normal or 'natural' wellbore operating conditions of temperature and pressure at a particular depth or elevation in the wellbore, as well as the normal or 'natural' chemistry for the drilling mud or pumping/frac fluids used during completion operations. In other words, no special chemicals, acids, sources of radiation, abrasive particles, etc. need be introduced into the wellbore or carried within the downhole tool itself to initiate the degradation or dissolution of the time-dissolvable degradable retainer 80, which will automatically degrade within the predetermined period of time inside the natural wellbore environment.

For example, the degradable retainer 80 can include at least one biodegradable ball 82 that can be positioned against the bridge plug 54. As shown in FIG. 5, the degradable retainer can further comprise two (or three or four) biodegradable balls 82 that can be rigid prior to dissolving and can hold the bridge plug 54 in place against the transition surface 26 or valve seat of the flowbore so as to restrict flow in either direction of the wellbore. As the at least one biodegradable ball 82 dissolves, the diameter of the ball decreases until, as shown in FIG. 6, the bridge plug 54 or flow restrictor is allowed to rise upward and create the gap 28 between the bridge plug 54 and the tapered transition region 26. The gap 28 can vent the higher pressure gas or oil from the recently fractured oil or gas formation(s) below, and allow upward fluid flow.

In this way, the degradable retainer 80 can retain the bridge plug 54 in the closed position for the predetermined time so that the downhole tool 50 acts as a traditional bridge plug for an initial, predetermined period of time. After the degradable retainer 80 has sufficiently degraded the bridge plug can move between the closed position and the open position so that the downhole tool 50 now operates as a traditional frac plug. Thus, the downhole tool 50 with convertible bridge valve 52 is convertible from a bridge plug to a frac plug after installation in the wellbore, and without any other intervention down the wellbore.

It is a particular advantage of the present invention that the degradable retainer 80 can degrade over a predetermined period of time, which allows the convertible bridge valve 52 to act as a bridge plug for that predetermined time period. In one aspect, the degradable retainer 80 can be at least one biodegradable ball 82 that can degrade over a period of hours. In another aspect, the biodegradable balls 82 can degrade over a period of days or even weeks. The biodegradable balls 82 can be color coded to indicate the length of time the balls will last before degrading. An example of biodegradable balls that may be used in the present invention is BioBalls soluble ball sealers available from Santrol of Texas.

The convertible bridge valve 52 can also include an annulus 56 that can be positioned within the upper cavity 22 of the flowbore 20 such that the degradable retainer 80 is disposed between the annulus 56 and the bridge plug 54. In its initial configuration, the annulus can press against the degradable retainer 80, which in turn can press against the bridge plug 54 or flow restrictor so as to retain the bridge plug in the closed position until the degradable retainer degrades. In this way, the degradable retainer 80 can act as a trapped spacer between the adjustable annulus 56 and the bridge plug 54. The inner diameter of the annulus 56 can be designed to pass a ball or spacer of a specified size so that the dissolvable ball or spacer must achieve a certain minimum diameter or size to be expelled from between the bridge plug 54 and the annulus 56. This is yet another way to control the time needed to convert the operation of the plug.

The annulus 56 can have a through aperture 58 that can allow visibility of the degradable retainer 80. As noted above, the degradable retainer 80 can be color coded according to a length of time of degradation so as to allow a user to determine the time of degradation by visually observing the color of the degradable retainer through the aperture 58 in the adjustable annulus 56.

The plug body 12, bridge plug 54, and adjustable annulus 56 can all be made from composite materials, including fiberglass and resin, carbon fiber and resin, and graphite fiber and resin. Other composite materials known to those of skill in the art may also work provided the materials can withstand the extreme environmental temperatures, pressures, and chemicals commonly found in a natural gas or oil well.

It will be appreciated that the degradable retainer 80 or spacer can be replaced with a permanent retainer or spacer (not shown) so as to permanently close the convertible bridge valve 52 and form a more permanent bridge seal. In one aspect of the present invention, for example, the permanent retainer can include at least one metal ball, such as a brass ball, a cast iron ball, an aluminum ball, and the like.

Figure 7:
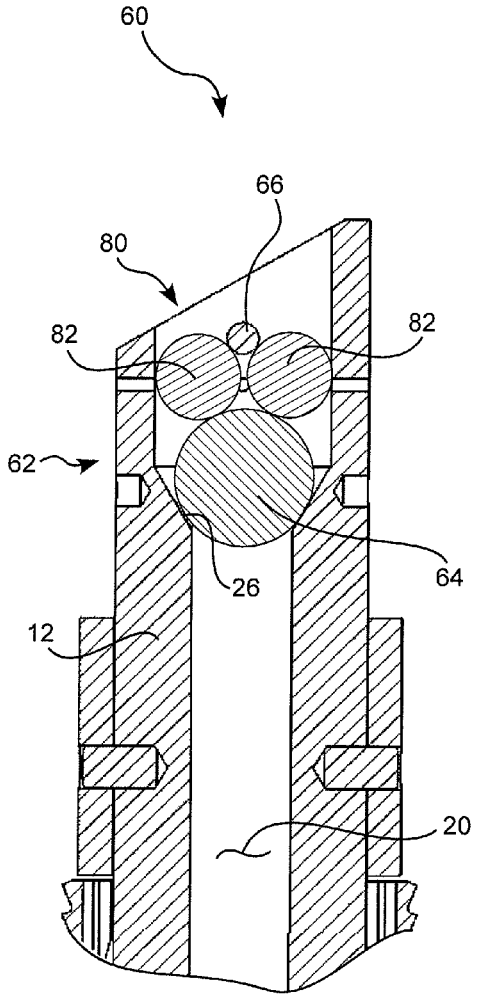
FIG. 7 is a cross-sectional view of the downhole tool of FIG. 1 in accordance with another exemplary embodiment of the present invention, shown with a flow restrictor in a closed configuration.
Figure 8:
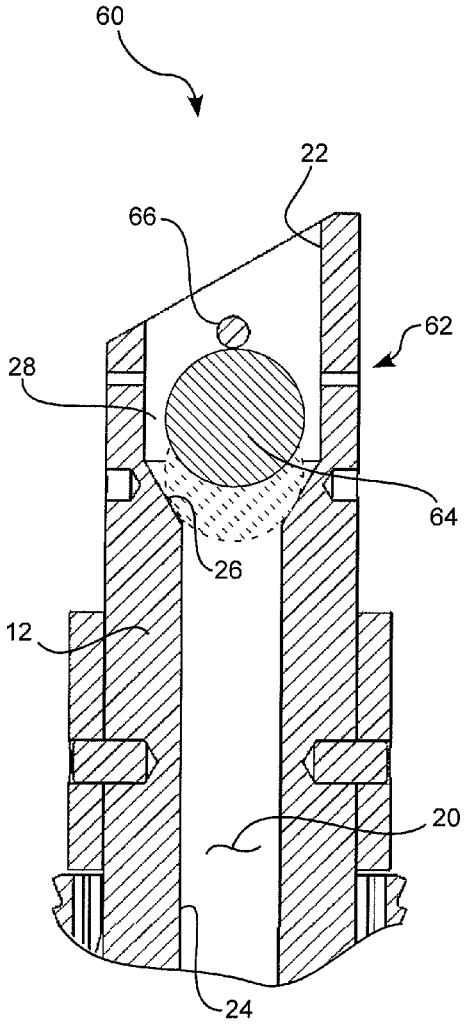
FIG. 8 is a cross-sectional view of the downhole tool of FIG. 8, shown with the flow restrictor a movable configuration.

The bridge plug 54 and annulus 56 of convertible bridge valve 52 can be removed and replaced with a movable frac plug or ball 64 and retaining pin 66 to form a convertible frac valve 62, as illustrated in FIGS. 7-8, and in accordance with exemplary embodiment 60 of the present invention. The frac ball 64 can be a solid, rounded body with a smooth outer surface that is configured to seal against the valve seat or tapered transition surface 26 of the flowbore 20 to close off and prevent the flow of fluid through the flowbore. Similar to the convertible bridge valve 52, the convertible frac valve 62 can also include the degradable retainer 80 or spacer comprised of at least one, but preferably at least two, biodegradable balls 82. The diameter of the pin 66 can be adjusted to assure that the ball 82 must be of some minimum diameter in order to pass through the gap between pin and upper chamber 28.

In an initial configuration, as shown in FIG. 7, the time-dissolvable biodegradable balls 82 and the non-dissolvable frac ball 64 can be sized together so that the biodegradable balls and the frac ball are captured between the tapered transition surface 26 on the bottom and the retaining pin 66 on the top. Thus, in its initial configuration the retaining pin 66 can press against the degradable retainer 80, which in turn can press against the frac ball 64 (or flow restrictor) so as to retain the frac ball in the closed position and prevent the upward or downward flow of fluid until the degradable retainer 80 degrades. In this way, the convertible frac valve 62 can operate as a bridge plug in a first state of fluid flow through the flowbore, and the degradable retainer 80 can act as a trapped spacer between the retaining pin 66 and the frac ball 64.

As described hereinabove, the degradable retainer 80 or spacer can degrade over a predetermined period of time while allowing the convertible frac valve 62 to act as a bridge plug for that predetermined time period. In one aspect, the degradable retainer 80 can include a set of biodegradable balls 82 that can degrade over a period of hours when exposed to a set of predetermined environmental conditions. The environmental conditions can include normal wellbore operating conditions of temperature and pressure at a particular depth or elevation in the wellbore, as well as the normal chemistry for the drilling mud or pumping/frac fluids used during completion operations. In another aspect, the set of biodegradable balls 82 can degrade over a period of days or even weeks. The biodegradable balls 82 can be color coded to indicate the length of time the balls will last before degrading.

After the degradable retainer 80 has sufficiently degraded the frac ball 64 can become movable between the closed position and the open position so that the downhole tool 60 now operates as a traditional frac plug. Thus, the downhole tool 60 with the convertible frac valve 62 is convertible from a bridge plug to a frac plug after installation in the wellbore, and without any other intervention down the wellbore. Upon the degradation or dissolution of the time-dissolvable degradable retainer 80, the retaining pin 66 disposable in the cavity 22 functions to retain the frac ball 64 with the flowbore 20, as shown in FIG. 8. In this second state of fluid flow through the flowbore, the frac ball 64 can be forced into a closed position against the valve seat or tapered transition surface 26 by a downward pressure and into an open position by an upward pressure. The retaining pin 66 can retain the ball 64 in the upper cavity 22 when the convertible frac valve 62 is in the open position.

Figure 9:
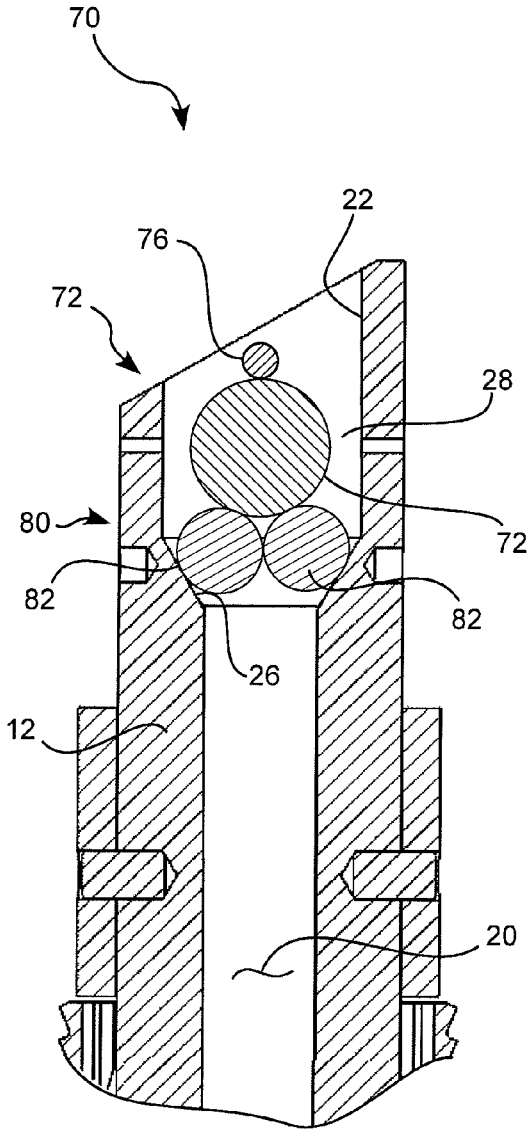
FIG. 9 is a cross-sectional view of the downhole tool of FIG. 1 in accordance with another exemplary embodiment of the present invention, shown with a flow restrictor in an open configuration.
Figure 10:
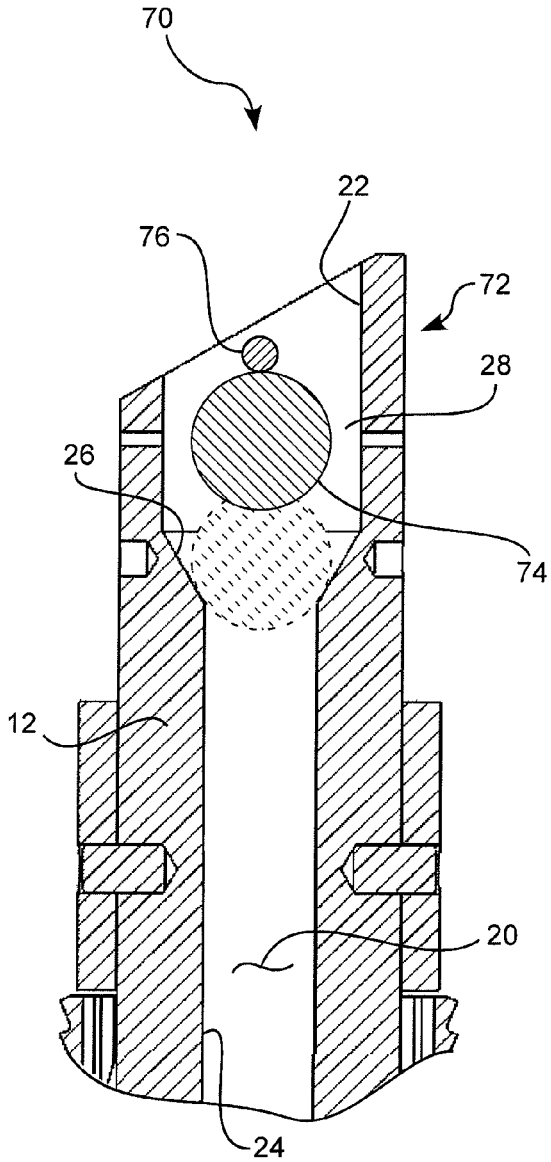
FIG. 10 is a cross-sectional view of the downhole tool of FIG. 9, shown with the flow restrictor a movable configuration.

In another embodiment 70 of the present invention illustrated in FIGS. 9-10, the initial position of the frac ball 74 and degradable retainer 80 or spacer can be reversed, so that the degradable retainer or biodegradable balls 82 can press against the tapered transition surface 22 of the flowbore 20 while the frac ball can be secured against the retaining pin 76 (see FIG. 9). It is to be appreciated that in this first state of fluid flow through the flowbore the biodegradable balls 82 will not form a seal against the upward or downward flow of fluid, but instead will provide a passage 28 through the flowbore 20 that allows fluid to freely pass in both directions through the downhole tool 70. In this way, the convertible open-to-frac valve 72 can operate as an open wellbore in a first state of fluid flow through the flowbore, and the degradable retainer 80 can act as a trapped spacer between the frac ball 64 and tapered transition surface 22.

However, as described above, the time-dissolvable biodegradable balls will eventually dissolve or degrade until the frac ball 74 can become movable between the closed position and the open position, so that the downhole tool 70 now operates as a traditional frac plug is a second state of fluid flow through the flowbore. Thus, the convertible open-to-frac valve 72 is convertible from an open passage to a frac plug after installation in the wellbore, and without any other intervention down the wellbore. An orifice of predetermined inner diameter can be installed in the tapered surface 26 or throat so the dissolvable ball would have to have shrunk to a certain minimum diameter to pass through the orifice and down the bore 20.

The embodiment 70 of the present invention having a convertible open-to-frac valve 72 can be particularly useful when setting a well completion plug in a horizontal well, where gravity may no longer be sufficient to draw the plug into the desired position. In horizontal sections of the well the plug and setting tool are moved into position by pumping fluid into the well. Some fluid flows through the annulus between the casing I.D. and the plug O.D, which helps "drag" the plug and setting tool along the pipe while the dynamic pressure of the fluid pushes the plug into position. Once the plug and setting tool are in the correct position, the plug is set into the case and the setting tool can be removed.

In previous designs, if either the well completion plug or setting tool malfunctioned it was impossible to pump down another plug to set above the malfunctioned plug because fluid flow could not pass through the frac ball seal. With embodiment 70 of the present invention, however, there exists an initial window of time, ranging from a few hours to a few days, in which it is possible to pump down another completion plug to be set above the first plug because the fluid can now flow through the first plug. Once the degradable retainer 80 or biodegradable balls 82 dissolve, the frac ball 74 is able to seal against the valve seat or tapered transition surface 26 and create the seal needed to fracture the rock formation above the well completion plug.

Figure 11:
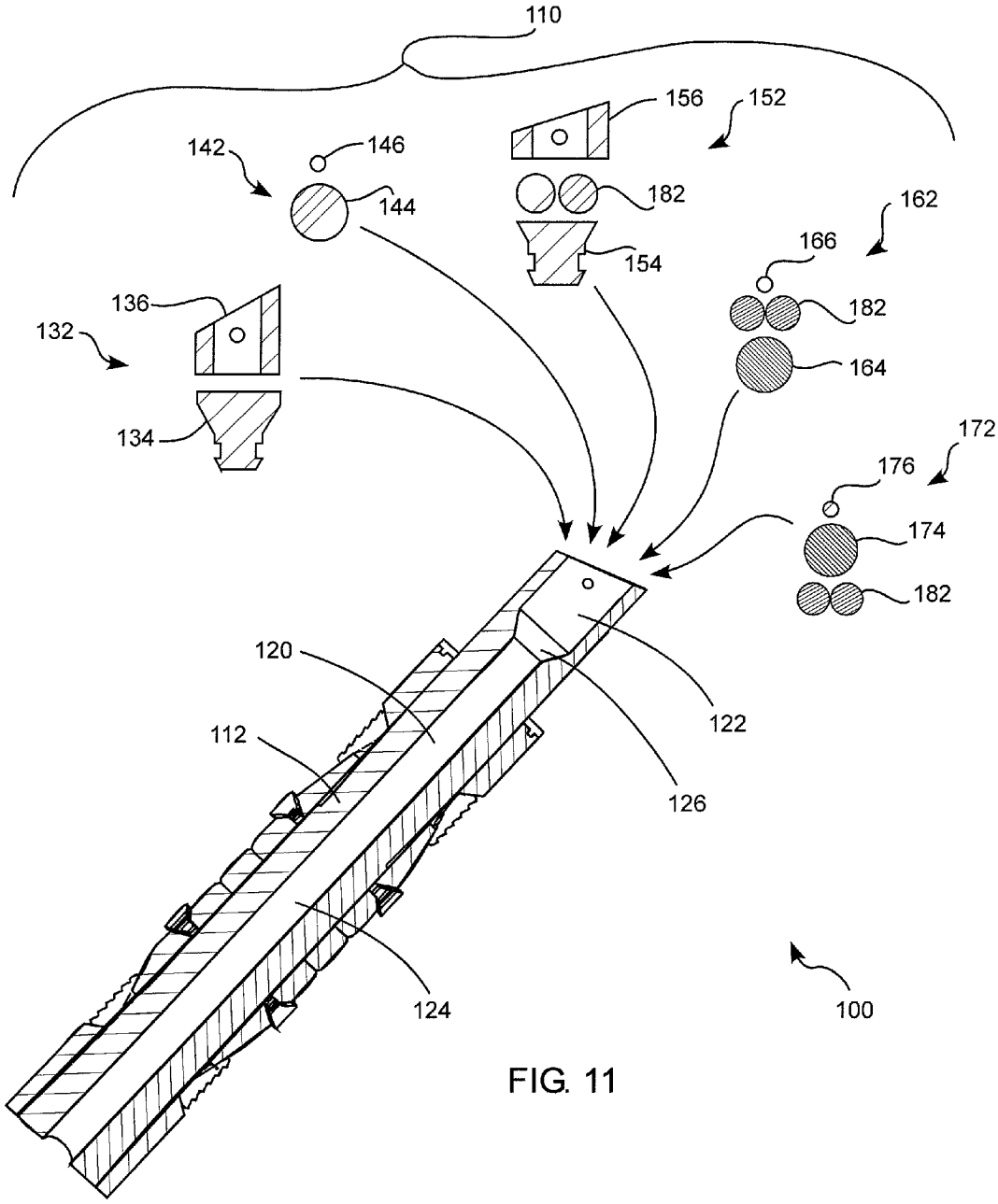
FIG. 11 is a cross section view of a downhole tool system in accordance with another exemplary embodiment of the present invention.

Illustrated in FIG. 11 is a downhole tool system or kit, indicated generally at 100, in accordance with another embodiment of the present invention for use in completing a well such as a natural gas or oil well. The downhole tool system or kit 100 can be similar in many respects to the downhole tool 10 described above and shown in FIGS. 1-10, and can include a plug body 112 with a flowbore 120 formed therein and a variety of seal/flow valves 110 selected from a plurality of interchangeable valve components. The seal/flow valves 110 can be selectively disposable in the flowbore's upper cavity 122 and tapered transition surface 126 of the flowbore 120 so as to control fluid flow through the main passage 124 of the flowbore.

A variety of plug bodies 112 of different sizes and configurations can be provided to accommodate the various casing inner diameters that can be installed along the length the wellbore. It is to be appreciated that each size or configuration of plug body 112 can be configured to accommodate the same set of seal/flow valves 110, so that same set of seal/flow valves 110 can be used with the various sizes and configurations of downhole well completion tools 110 used to complete the well.

In one aspect, the variety of seal/flow valves 110 disposable within the flowbore 120 of the plug body 112 can include a bridge seal 132, a frac valve 142, a convertible bridge valve 152, a convertible frac valve 162, and a convertible open-to-frac valve 172. As a result, the exemplary downhole tool system 100 of the present invention can be selected from a bridge completion plug, a frac completion plug, a convertible bridge plug, a convertible frac plug, and a convertible open-to-frac plug. Selection of the type of downhole tool can be based on a set of environmental conditions or operational requirements of the well.

The permanent bridge seal 132 can include a bridge plug or slug 134 that can be secured in the flowbore 120 of the plug body 112 by adhesives, shear pins, and by a permanent annulus retainer 136. The permanent retainer 136 can help to hold the permanent bridge plug 134 in order to restrict fluid flow through the downhole tool 100. As described above, the permanent retainer can include at least one metal ball in place of the degradable ball.

The frac plug valve 142 can include a frac ball 144 that can be movably disposed in the upper cavity 122 of the flowbore 120. The frac ball 144 can move between an open position that allows fluid flow through the flowbore 120 and a closed position that restricts fluid flow through flowbore. A retaining pin 146 can help to keep the frac ball in the flowbore's upper cavity.

Similar to the embodiment 50 (FIGS. 5 and 6) described hereinabove, the convertible bridge valve 152 can include a movable bridge plug 154. The bridge plug 154 can be temporarily retained in the flowbore's upper cavity 122 in the closed first position against the tapered transition surface 122 or valve seat by the degradable retainer or spacer, which can be biodegradable balls 182. The biodegradable balls 182 can hold the bridge plug in place in order to temporarily restrict fluid flow through the flowbore. The biodegradable balls 182 can be degradable or dissolvable to allow the bridge plug 154 to move between the closed first position and an open second position that allows fluid to flow upwards through the flowbore. The convertible bridge valve 152 can also include an annulus 156 that initially can press against the biodegradable balls 182, which in turn can initially press against and secure the bridge plug 154 in the closed first position. The annulus can also operate to prevent the bridge plug 154 from exiting the flowbore after the biodegradable balls 182 have dissolved.

The convertible frac valve 162 can include a movable frac ball 164. The frac ball 164 can be temporarily retained in the flowbore's upper cavity 122 in the closed first position against the tapered transition surface 122 or valve seat by the degradable retainer or spacer, which can be biodegradable balls 182. Like the convertible bridge valve described above, the biodegradable balls 182 can hold the frac ball in place in order to temporarily restrict fluid flow through the flowbore. The biodegradable balls 182 can be degradable or dissolvable to allow the frac ball 164 to move between the closed first position and an open second position that allows fluid to flow upwards through the flowbore. The convertible frac valve 162 can also include a retaining pin 166 that initially can press against the biodegradable balls 182, which in turn can initially press against and secure the frac ball 164 in the closed first position. The retaining pin 166 can also operate to prevent the frac ball 164 from exiting the flowbore after the biodegradable balls 182 have dissolved.

The convertible open-to-frac valve 172 can also include a movable frac ball 174, except that the frac ball 174 can be temporarily retained in the flowbore's upper cavity 122 in an open first position against retaining pin 176 by the degradable retainer or spacer, which in this instance can be biodegradable balls 182. The biodegradable balls 182 can hold the frac ball in place in order to temporarily allow fluids to freely flow through the flowbore 120. The biodegradable balls 182 can be degradable or dissolvable to allow the frac ball 174 to move between the open first position and a closed second position that prevents any downward flow of fluid through the flowbore. After the biodegradable balls 182 have dissolved, the retaining pin 176 can also operate to prevent the frac ball 174 from exiting the flowbore when greater pressure from below the well completion plug forces fluid upwards through the flowbore 120

It is a particular advantage that the various seal/flow valves 110 can be assembled from a plurality of interchangeable valve components. For example, each seal/flow valve 132, 142, 152, 162 and 172 can be changeable in the field at remote well sites. Changing sets may only require simple tools, such as a hammer and punch along with some fast-drying adhesive. The flow valves can be sold as component kits that can be installed at any time during the completion process. Additionally, color coded strips (not shown) can be provided and placed on the outside of the plug body 12 so as to delineate which component set is installed in the plug body.

This flexibility and ease of use reduces part count and is advantageous for holding down manufacturing costs. Additionally, it allows the oil service companies to better manage their downhole tool inventories due to the fact that the downhole tool system 100 can be configured at company facilities or well sites in order to meet market demands rather than having to order them from a factory in the desired configuration.

Figure 12:
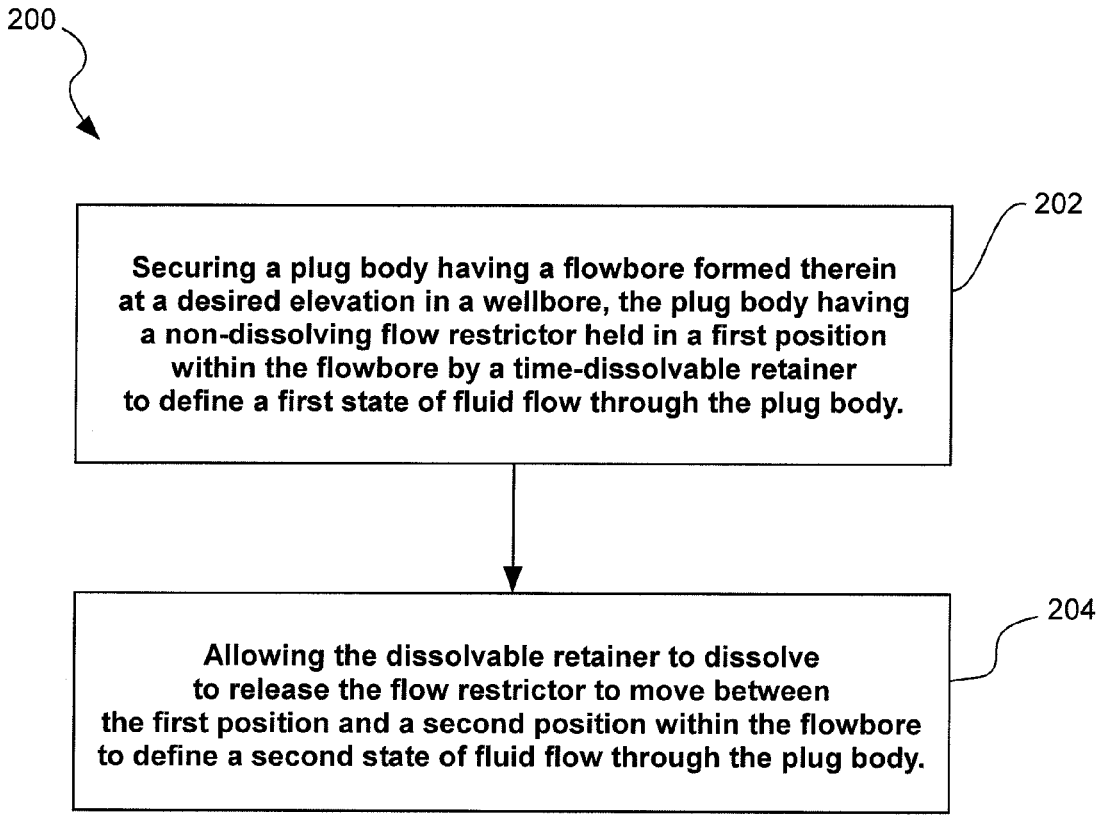
FIG. 12 is a flowchart depicting a method for completing a natural gas or oil well with a downhole tool, in accordance with another exemplary embodiment of the present invention.

Illustrated in FIG. 12 is a flowchart depicting a method 200 for completing a natural gas or oil well with a well completion tool, in accordance with an exemplary embodiment of the invention. The method includes the step of securing 202 a well completion tool having plug body with a flowbore formed therein at a desired elevation in a wellbore, the plug body having a non-dissolving flow restrictor held in a first position within the flowbore by a time-dissolvable retainer so as to define a first state of fluid flow through the plug body. The method further includes the step of allowing 204 the time-dissolvable retainer to dissolve to release the flow restrictor to move between the first position and a second position within the flowbore so as to define a second state of fluid flow through the plug body. In one aspect of the invention, allowing the time-dissolvable retainer to dissolve further comprises forming a one-way frac plug in the upper end of the flowbore.

Figure 13:
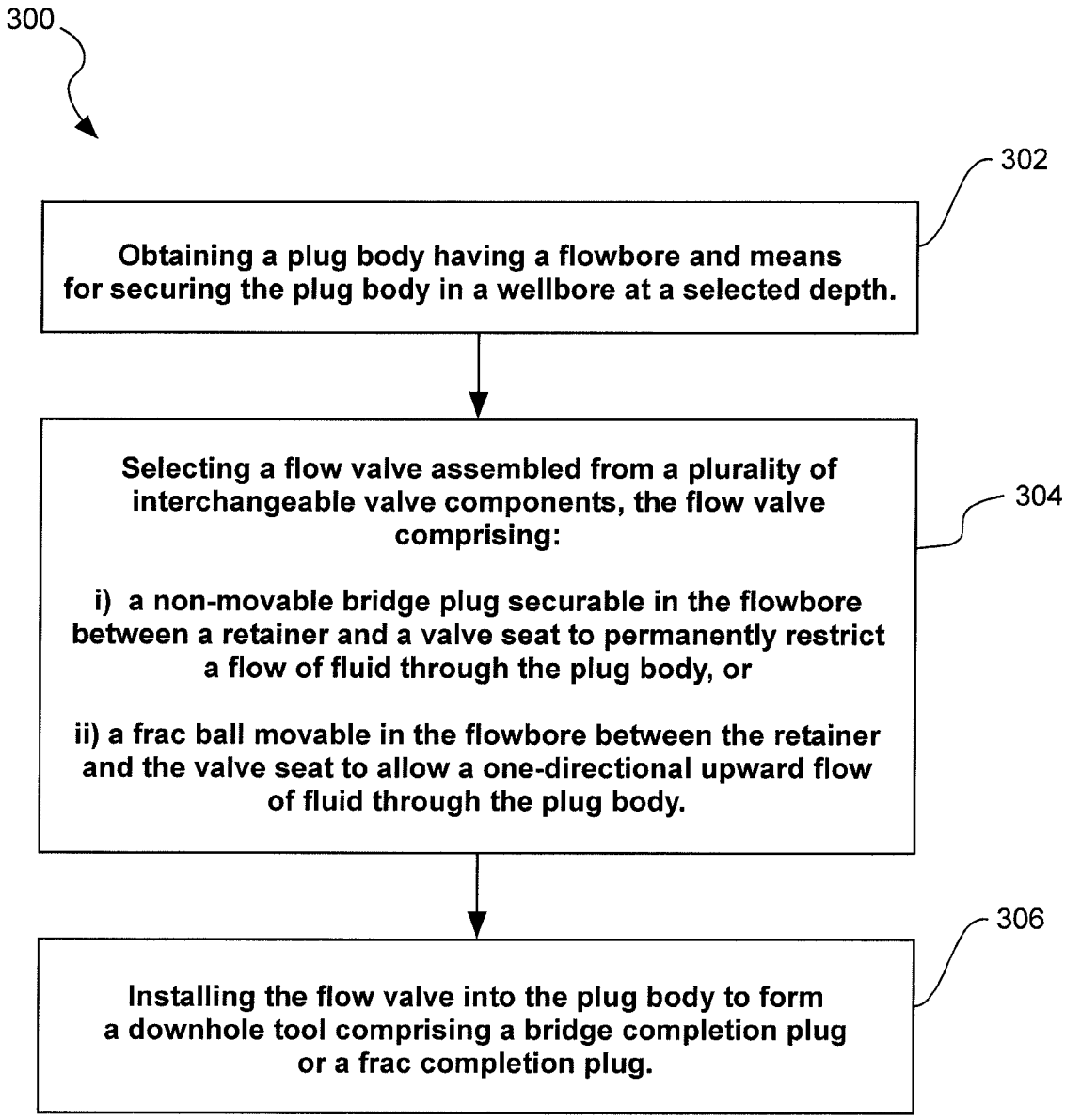
FIG. 13 is a flowchart depicting a method for forming a downhole completion tool for a well having a controllable fluid flow, in accordance with yet another exemplary embodiment of the present invention.

Illustrated in FIG. 13 is a flowchart depicting a method 300 for forming a downhole completion tool for a well having a controllable fluid flow, in accordance with another exemplary embodiment of the invention. The method includes the step of obtaining 302 a plug body having a flowbore formed therein and a means for securing the plug body in a wellbore of the well at a selected depth. The method also includes the step of selecting 304 a flow valve assembled from a plurality of interchangeable valve components, the flow valve comprising i) a non-movable bridge plug securable in the flowbore between a retainer and a valve seat to permanently restrict a flow of fluid through the plug body, or ii) a frac ball movable in the flowbore between the retainer and the valve seat to allow a one-directional upward flow of fluid through the plug body. The method further includes the step of installing 306 the flow valve into the plug body to form a downhole tool comprising a bridge completion plug or a frac completion plug.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given above.

What is claimed and desired to be secured by Letters Patent is:

1. A downhole tool for use in completing a well, comprising:

a) a plug body selectively securable to a wellbore at a desired depth and having a flowbore formed therein;

b) a non-dissolvable flow restrictor disposed in the flowbore and operable to restrict a flow of fluids through the flowbore;

c) a time-dissolvable retainer pressed against the flow restrictor to retain the flow restrictor in a first position within the plug body, the retainer being dissolvable within a predetermined passage of time inside a natural wellbore environment to release the flow restrictor to move between the first position and a second position within the plug body; and d) the time-dissolvable retainer comprising at least one biodegradable ball.

2. The downhole tool of claim 1, wherein the at least one biodegradable ball is selected from a set of different biodegradable balls, each biodegradable ball being configured to dissolve within a different predetermined passage of time.

3. The downhole tool of claim 1, wherein the non-dissolvable flow restrictor further comprises a frac ball configured to seat against a sealing surface in the upper end of the flowbore in a closed position to seal the flowbore against the flow of fluids.

4. The downhole tool of claim 1, wherein the non-dissolvable flow restrictor further comprises a bridge plug movably disposed within the upper end of the flowbore and positionable in a closed position to seal the flowbore against the flow of fluids.

5. The downhole tool of claim 1, wherein the flow restrictor closes the flowbore in the first position to prevent the flow of fluid in either direction, and movement of the flow restrictor between the first position and the second position after the time-dissolvable retainer dissolves allows for a one-directional upward flow of fluid through the flowbore.

6. The downhole tool of claim 1, wherein the flow restrictor in the first position allows a bi-directional flow of fluids through the flowbore, and movement of the flow restrictor between the first position and the second position after the time-dissolvable retainer dissolves allows for a one-directional upward flow of fluid through the flowbore.

7. The downhole tool of claim 1, wherein the time-dissolvable retainer is removable and replaceable with a permanent retainer to permanently close the valve and form a bridge plug.

8. The downhole tool of claim 7, wherein the permanent retainer further comprises at least one metal ball.

9. A downhole tool for use in completing a well, comprising:

a) a plug body selectively securable to a wellbore at a desired depth and having a flowbore formed therein;

b) a non-dissolvable flow restrictor disposed in the flowbore and operable to restrict a flow of fluids through the flowbore;

c) a time-dissolvable retainer operably coupled to the flow restrictor to retain the flow restrictor in a first position within the plug body, the retainer being dissolvable within a predetermined passage of time inside a natural wellbore environment to release the flow restrictor to move between the first position and a second position within the plug body;

d) the flow restrictor closing the flowbore in the first position to prevent the flow of fluid in either direction, and movement of the flow restrictor between the first position and the second position after the time-dissolvable retainer dissolves allows for a one-directional upward flow of fluid through the flowbore;

e) an annulus positioned in the flowbore such that the time-dissolvable retainer is disposed between the annulus and the flow restrictor; and f) the annulus is positionable in the flowbore to press against the time-dissolvable retainer to cause the time-dissolvable retainer to press against the flow restrictor, so as to retain the flow restrictor in the closed position until the time-dissolvable retainer dissolves.

10. The downhole tool of claim 9, wherein the annulus has a through aperture to allow visibility of the time-dissolvable retainer, and wherein the time-dissolvable retainer is color coded according to the predetermined passage of time so as to allow a user to identify the predetermined passage of time by visually observing the color of the time-dissolvable retainer through the aperture.

11. A downhole tool for use in completing a well, comprising:

a) a plug body selectively securable to a wellbore at a desired depth and having a flowbore formed therein;

b) a non-dissolvable flow restrictor disposed in the flowbore and operable to restrict a flow of fluids through the flowbore;

c) a time-dissolvable retainer operably coupled to the flow restrictor to retain the flow restrictor in a first position within the plug body, the retainer being dissolvable within a predetermined passage of time inside a natural wellbore environment to release the flow restrictor to move between the first position and a second position within the plug body;

d) the flow restrictor in the first position allows a bi-directional flow of fluids through the flowbore, and movement of the flow restrictor between the first position and the second position after the time-dissolvable retainer dissolves allows for a one-directional upward flow of fluid through the flowbore;

e) a retaining pin in the flowbore such that the flow restrictor is disposed between the retaining pin and the time-dissolvable retainer; and f) the retaining pin positionable in the flowbore to press against the flow restrictor to cause the flow restrictor to press against the time-dissolvable retainer so as to retain the flow restrictor in an open position until the time-dissolvable retainer dissolves.

12. The downhole tool of claim 11, wherein the retaining pin allows visibility of the time-dissolvable retainer, and wherein the time-dissolvable retainer is color coded according to the predetermined passage of time so as to allow a user to identify the predetermined passage of time by visually observing the color of the time-dissolvable retainer through the aperture.

13. A downhole tool system for completing a well, comprising:

a) a plug body selectively securable to a wellbore at a desired depth and having a flowbore formed therein;

b) a flow valve comprising a plurality of interchangeable components selectively disposable in the flowbore to control fluid flow therethrough, the plurality of interchangeable components comprising:

i) a non-dissolvable flow restrictor disposed in the flowbore and operable to restrict a flow of fluids through the flowbore; and ii) a time-dissolvable retainer pressed against the flow restrictor to retain the flow restrictor in a first position within the plug body, the retainer being dissolvable within a predetermined passage of time inside a natural wellbore environment to release the flow restrictor to move between the first position and a second position within the plug body;

c) the interchangeable components being selectively configurable to retain the flow valve in an open position allowing a bi-directional flow of fluids through the flowbore, or in a closed position preventing the flow of fluids in either direction through the flowbore, until after the time-dissolvable retainer dissolves; and d) the time-dissolvable retainer comprising at least biodegradable ball.

14. The downhole tool system of claim 13, wherein the at least one biodegradable ball is selected from a set of different biodegradable balls, each biodegradable ball being configured to dissolve within a different predetermined passage of time.

15. The downhole tool system of claim 13, wherein the non-dissolvable flow restrictor further comprises a frac ball configured to seat against a sealing surface in the upper end of the flowbore in a closed position to seal the flowbore against the flow of fluids.

16. The downhole tool system of claim 13, wherein the interchangeable components are secured within the flowbore with a non-dissolvable retainer allowing visibility of the time-dissolvable retainer, and wherein the time-dissolvable retainer is color coded according to the predetermined passage of time so as to allow a user to identify the predetermined passage of time by visually observing the color of the time-dissolvable retainer.

17. A downhole tool system for completing a well, comprising:

a) a plug body selectively securable to a wellbore at a desired depth and having a flowbore formed therein;

b) a flow valve assembled from a plurality of interchangeable components selectively disposable in the flowbore to control fluid flow therethrough, the plurality of interchangeable components including:

i) a permanent bridge plug securable in the flowbore of the plug body by a permanent retainer to permanently restrict fluid flow through the flowbore;

ii) a permanent frac ball movable in the flowbore of the plug body between an open position that allows one-directional fluid flow through the flowbore and a closed position that restricts fluid flow through the flowbore; and iii) a degradable retainer disposable in the flowbore with the permanent frac ball or a movable flow restrictor to temporarily retain the permanent frac ball or the movable flow restrictor in a closed position or an open position, the degradable retainer being degradable or dissolvable in a predetermined passage of time inside a natural wellbore environment to release the permanent frac ball or the flow restrictor to move; and c) the permanent bridge plug or the permanent frac ball or the movable flow restrictor closes the flowbore in the first position to prevent the flow of fluid in either direction, and movement of the permanent bridge plug or the permanent frac ball or the movable flow restrictor between the first position and the second position after the degradable retainer degrades or dissolves allows for a one-directional upward flow of fluid through the flowbore; and the degradable retainer is positioned to press against the permanent bridge plug or the permanent frac ball or the movable flow restrictor so as to retain the permanent bridge plug or the permanent frac ball or the movable flow restrictor in the closed position until the degradable retainer degrades or dissolves.

18. A downhole tool system for completing a well, comprising:

a) a plug body selectively securable to a wellbore at a desired depth and having a flowbore formed therein;

b) a flow valve assembled from a plurality of interchangeable components selectively disposable in the flowbore to control fluid flow therethrough, the plurality of interchangeable components including:

i) a permanent bridge plug securable in the flowbore of the plug body by a permanent retainer to permanently restrict fluid flow through the flowbore;

ii) a permanent frac ball movable in the flowbore of the plug body between an open position that allows one-directional fluid flow through the flowbore and a closed position that restricts fluid flow through the flowbore; and iii) a degradable retainer disposable in the flowbore with the permanent frac ball or a movable flow restrictor to temporarily retain the permanent frac ball or the movable flow restrictor in a closed position or an open position, the degradable retainer being degradable or dissolvable in a predetermined passage of time inside a natural wellbore environment to release the permanent frac ball or the flow restrictor to move; and c) the permanent frac ball or the movable flow restrictor in the first position allows a bi-directional flow of fluids through the flowbore, and movement of the permanent frac ball or the movable flow restrictor between the first position and the second position after the degradable retainer degrades or dissolves allows for a one-directional upward flow of fluid through the flowbore; and the degradable retainer is positioned to press against the permanent frac ball or the movable flow restrictor so as to retain the permanent frac ball or the movable flow restrictor in the open position until the degradable retainer degrades or dissolves.

19. A downhole tool for use in completing a well, comprising:

a) a plug body selectively securable to a wellbore at a desired depth and having a flowbore formed therein;

b) a non-dissolvable flow restrictor disposed in the flowbore and operable to restrict a flow of fluids through the flowbore;

c) a time-dissolvable retainer pressed against the flow restrictor to retain the flow restrictor in a first position within the plug body, the retainer being dissolvable within a predetermined passage of time inside a natural wellbore environment to release the flow restrictor to move between the first position and a second position within the plug body; and d) the flow restrictor closes the flowbore in the first position to prevent the flow of fluid in either direction, and movement of the flow restrictor between the first position and the second position after the time-dissolvable retainer dissolves allows for a one-directional upward flow of fluid through the flowbore.

20. A downhole tool for use in completing a well, comprising:

a) a plug body selectively securable to a wellbore at a desired depth and having a flowbore formed therein;

b) a non-dissolvable flow restrictor disposed in the flowbore and operable to restrict a flow of fluids through the flowbore;

c) a time-dissolvable retainer pressed against the flow restrictor to retain the flow restrictor in a first position within the plug body, the retainer being dissolvable within a predetermined passage of time inside a natural wellbore environment to release the flow restrictor to move between the first position and a second position within the plug body; and d) the time-dissolvable retainer is removable and replaceable with a permanent retainer to permanently close the valve and form a bridge plug; and e) the permanent retainer further comprises at least one metal ball.

21. A downhole tool system for completing a well, comprising:

a) a plug body selectively securable to a wellbore at a desired depth and having a flowbore formed therein;

b) a flow valve comprising a plurality of interchangeable components selectively disposable in the flowbore to control fluid flow therethrough, the plurality of interchangeable components comprising:

i) a non-dissolvable flow restrictor disposed in the flowbore and operable to restrict a flow of fluids through the flowbore; and ii) a time-dissolvable retainer pressed against the flow restrictor to retain the flow restrictor in a first position within the plug body, the retainer being dissolvable within a predetermined passage of time inside a natural wellbore environment to release the flow restrictor to move between the first position and a second position within the plug body;

c) the interchangeable components being selectively configurable to retain the flow valve in an open position allowing a bi-directional flow of fluids through the flowbore, or in a closed position preventing the flow of fluids in either direction through the flowbore, until after the time-dissolvable retainer dissolves; and d) the interchangeable components are secured within the flowbore with a non-dissolvable retainer allowing visibility of the time-dissolvable retainer, and wherein the time-dissolvable retainer is color coded according to the predetermined passage of time so as to allow a user to identify the predetermined passage of time by visually observing the color of the time-dissolvable retainer.

* * * * *